US008596181B2

(12) United States Patent
Root, Jr.

(10) Patent No.: US 8,596,181 B2
(45) Date of Patent: Dec. 3, 2013

(54) WATERBORNE MUNITIONS SYSTEM

(75) Inventor: George Raymond Root, Jr., Gambrills, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 1655 days.

(21) Appl. No.: 11/007,471

(22) Filed: Dec. 8, 2004

(65) Prior Publication Data

US 2010/0000463 A1 Jan. 7, 2010

(51) Int. Cl.
*F41F 3/00* (2006.01)

(52) U.S. Cl.
USPC ..... 89/1.81; 89/1.809; 89/1.54; 89/1.816; 102/406; 102/412

(58) Field of Classification Search
USPC ..... 89/1.81, 1.809, 1.54, 1.816; 102/406, 102/411–413
See application file for complete search history.

(56) References Cited

U.S. PATENT DOCUMENTS 1,513,107 A * 10/1924 Hammond, Jr. ..... 102/412
1,542,543 A * 6/1925 Elia ..... 102/413
2,971,462 A * 2/1961 Goff ..... 102/413
3,696,251 A * 10/1972 Last et al. ..... 290/53
3,772,639 A * 11/1973 Snyder ..... 367/4
3,789,758 A * 2/1974 Plice ..... 102/413
3,961,389 A * 6/1976 Dovell et al. ..... 441/25
4,003,291 A * 1/1977 Vass et al. ..... 89/1.81
4,004,265 A * 1/1977 Woodruff et al. ..... 367/4
4,055,121 A * 10/1977 Jasperson et al. ..... 102/414
4,635,527 A * 1/1987 Carrier et al. ..... 89/1.816
5,170,005 A * 12/1992 Mabry et al. ..... 89/1.81
5,821,447 A * 10/1998 Reams et al. ..... 102/223
6,164,179 A * 12/2000 Buffman ..... 89/1.81
6,461,752 B1 * 10/2002 Leung ..... 429/20
6,487,952 B1 * 12/2002 Borgwarth et al. ..... 89/1.81

OTHER PUBLICATIONS

Submarine Rescue Equipment Transfer Pod Carousel Assembly, OceanWorks International [online], Undated [Retrieved on Apr. 15, 2009]. Retrieved from the Internet: <http://www.oceanworks.cc/cms/pdfs/9-4%20Transfer%20Pod%20Carousel.pdf>.*

Sub Rescue Equipment Flyer, OceanWorks International [online], Dec. 13, 2003 [Retrieved on Apr. 15, 2009]. Retrieved from the Internet: <http://web.archive.org/web/20031213152409/www.oceanworks.cc/products/subworks/subsea-ELSS-emergency-life-support-systems.html>.*

Internet Archive FAQ, Internet Archive [online], Undated [Retrieved on Jan. 2, 2010]. Retrieved from the Internet: <http://www.archive.org/about/faqs.php>.*

* cited by examiner

*Primary Examiner* — Jamie Kucab
(74) *Attorney, Agent, or Firm* — Kaplan Breyer Schwarz & Ottesen, LLC

(57) ABSTRACT

A waterborne munitions system is disclosed. The system includes a submersible munitions platform and a remote control module. The munitions platform has a plurality of canistered munitions, either waterborne, airborne, or both, which can be remotely launched via the remote control module.

23 Claims, 8 Drawing Sheets

WATERBORNE MUNITIONS SYSTEM

FIELD OF THE INVENTION

The present invention relates to munitions in general, and, more particularly, to a munitions-delivery system.

BACKGROUND OF THE INVENTION

A supported military force is required to transport "ready-fire" munitions in the battlefield. These "ready-fire" munitions include, for example, airborne munitions (e.g., direct-fire missiles, loitering missiles, airborne tagging system and reconnaissance UAVs, etc.) and waterborne munitions (e.g., UUVs, USVs, counter-mine UUVs and USVs, surface and subsurface tagging systems, small torpedos and other anti-submarine and anti-ship weapons, etc.).

To use these "ready-fire" munitions, the supported military force must establish a fire-support base. In dynamic combat operations in which the supported force is generally on the move, the fire-support base must be repeatedly established, dismantled, and then reestablished. Likewise, when evading hostile forces, the supported force must protect their supporting-fire resources, moving them as required.

This routine of establishing-dismantling-reestablishing fire support results in delays and interruptions in fire support. This can have dire consequences to a small, isolated, military force. And to the extent that ready-fire munitions are being shouldered by military personnel, their movements will be hampered and energy more quickly expended due to the bulk and weight of these munitions.

SUMMARY OF THE INVENTION

The illustrative embodiment of the invention is a system for launching munitions that avoids some of the drawbacks of the prior art. The system is capable of providing "on demand" or scheduled launches of a variety of munitions, including both airborne and waterborne munitions. The system is particularly useful for providing fire support for small military units that are operating in potentially hostile, remote, littoral environments.

The present munitions system is waterborne, geographically stationary once deployed in a body of water, and covert. In the illustrative embodiment, the munitions system includes a submersible munitions platform and a remote control module. In use, the munitions platform is deposited into a body of water near to the areas in which supported forces are or will be operating. The platform can be deposited into the water by aircraft, submarine, or boat.

Once deployed in the water, an anchor drops from the munitions platform to the bottom of the body of water. Anchored in this fashion, the horizontal movement of the platform is restricted. That is, the platform remains in a substantially fixed geographical position. Typically, the munitions platform will be used in water that has a depth of about 200 feet or less. This includes bays, lakes, rivers, and oceans (near the shore).

In combination with a winch, the anchor is used to pull the positively-buoyant platform down to a preplanned depth below the surface of the water to avoid detection. Typically, this "loitering" depth is about 20 to 30 feet. In some embodiments, a buoyancy system is used to decrease buoyancy to facilitate pull down of platform.

After reaching loitering depth, a floating antenna is deployed. Supported forces are then able to control or otherwise communicate with the submerged munitions platform using the remote control module. For example, the supported forces can direct the munitions platform to fire a waterborne munition while at loitering depth, or ascend to a firing depth to fire one or more of its airborne munitions. After firing airborne munitions, the supported forces can direct the munitions platform to re-submerge to loitering depth.

A second operation that occurs when the platform is deposited into water is activation of a stabilization system. In the illustrative embodiment, the stabilization system comprises a plurality of extendable arms, which, when extended, dampen rotational and vertical movements of platform. It is particularly important to stabilize the platform when launching multiple munitions in rapid succession.

The waterborne munitions platform improves the capability of supported units to maneuver stealthily and freely in heavily-defended enemy areas. The remote, covert location of the munitions platform eliminates the requirement for the supported forces to continuously transport "ready-fire" munitions. When circumstances dictate evasive maneuvers, the supported forces now do not have to be concerned about protecting their supporting-fire resources. During dynamic engagements with hostile forces, previously-deployed munitions platforms are continuously available to suppress enemy activity. Furthermore, personnel will no longer have to expend energy relocating their fire-support resources.

DETAILED DESCRIPTION

As used in this description and the appended claims, the term "munitions" means airborne munitions and waterborne munitions. Examples of airborne munitions include, without limitation, direct-fire missiles, loitering missiles, airborne tagging systems, and reconnaissance unmanned aerial vehicles ("UAVs"). Examples of waterborne munitions include, without limitation, small torpedos, other anti-submarine and anti-ship weapons, surface and subsurface tagging systems, counter-mine unmanned undersea vehicles ("UUVs") and unmanned surface vehicles ("USVs"), and reconnaissance UUVs and USVs.

Figure 1:
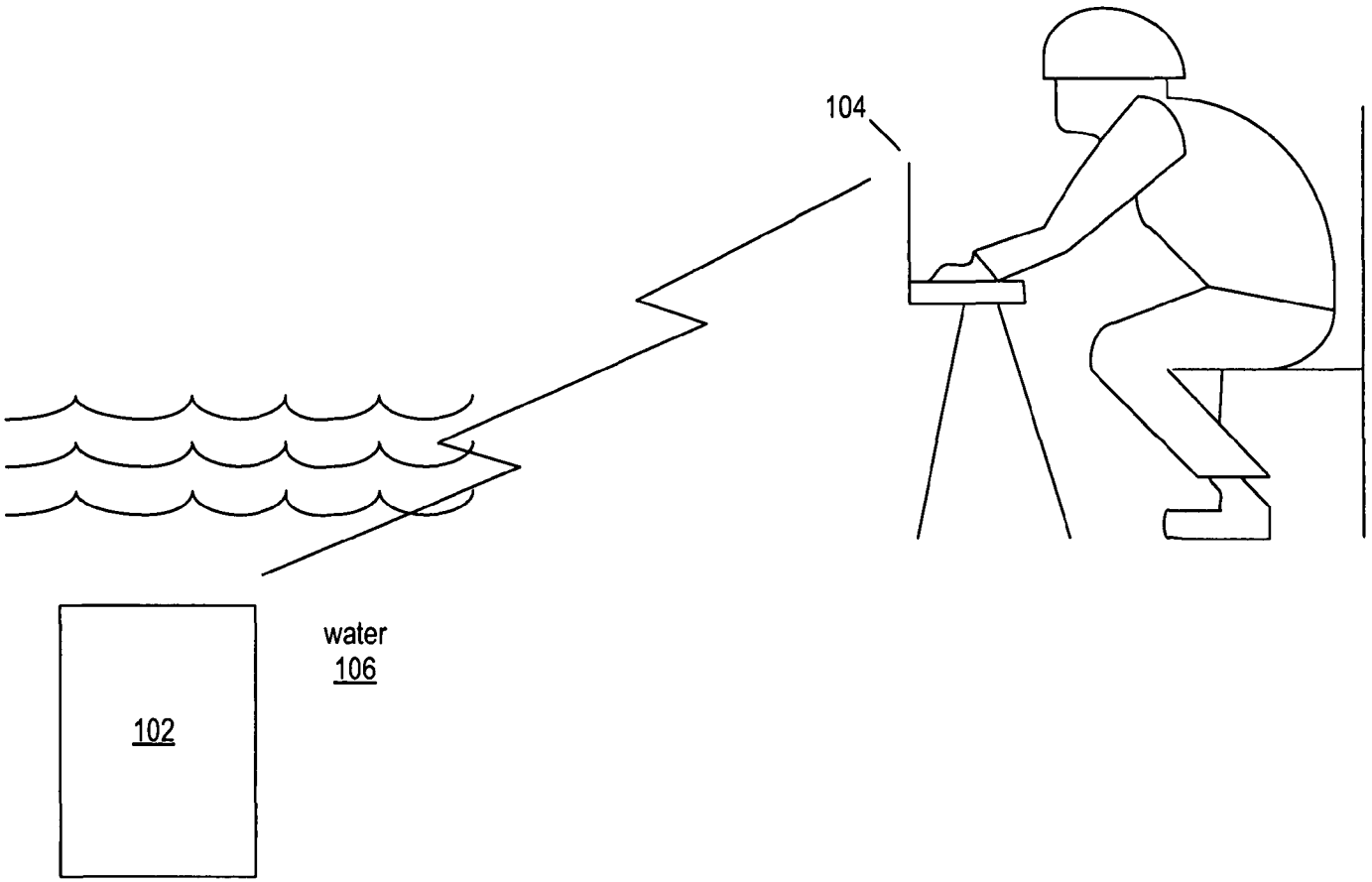
FIG. 1 depicts a submersible munitions platform and remote control module of a waterborne munitions system in accordance with the illustrative embodiment of the present invention.

FIG. 1 depicts waterborne munitions system 100. As depicted in FIG. 1, waterborne munitions system 100 is physically segregated into two structures: submersible munitions platform 102 and remote control module 104. In use, munitions platform 102 is submerged in a body of water 106 to provide covert fire support while remote control module 104, which is used to control at least some of the operations of munitions platform 102, is in the possession of military personnel.

Figure 2:
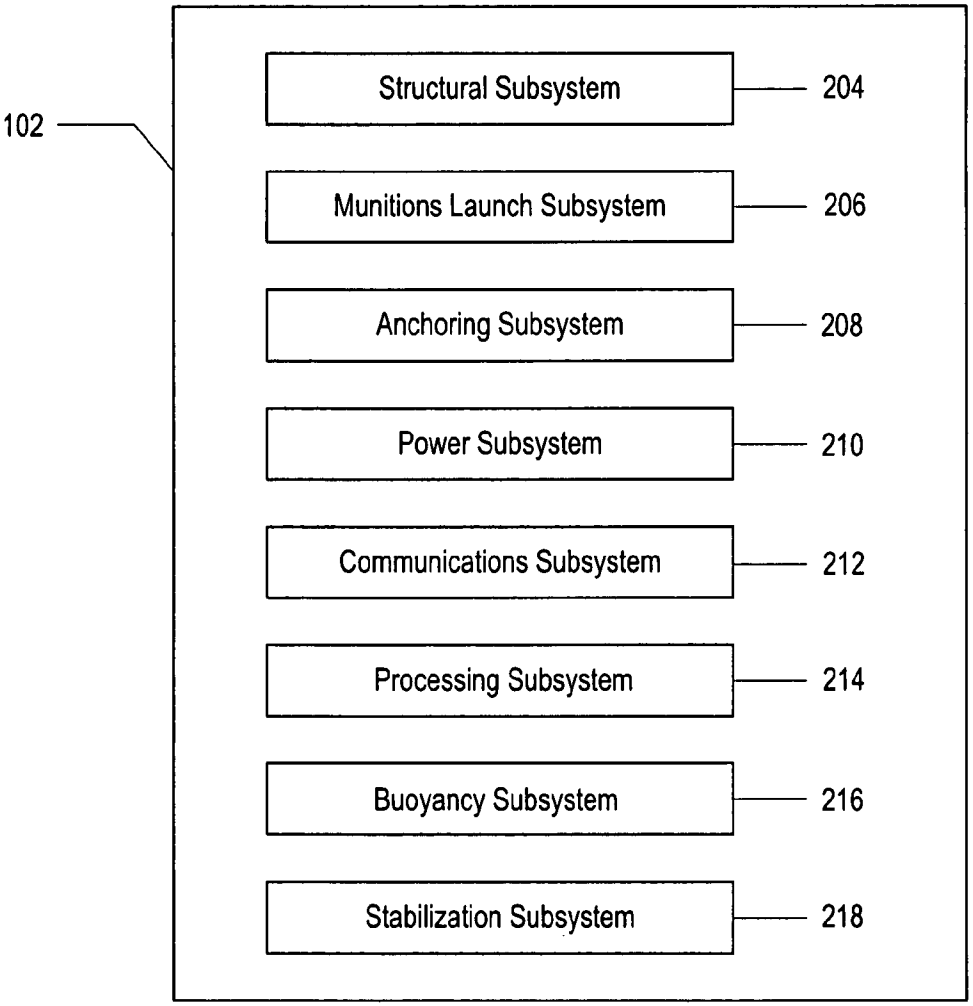
FIG. 2 depicts a functional subsystem diagram of the submersible munitions platform of the waterborne munitions system.

As depicted in FIG. 2, submersible munitions platform 102 is segregated into eight functional subsystems, including structural subsystem 204, munitions subsystem 206, anchoring subsystem 208, power subsystem 210, communications subsystem 212, processing subsystem 214, buoyancy subsystem 216, and stabilization subsystem 218.

Briefly, the various subsystems provide the following functionality:

- Structural subsystem 204 provides mechanical support for the other subsystems.
- Munitions subsystem 206 provides munitions and launch capability.
- Anchoring subsystem 208 fixes the geographical location of munitions platform 102 after deployment and provides depth control.
- Power subsystem 210 provides electrical power to munitions platform 102.
- Communications subsystem 212 supports communications between remote control module 104 and munitions platform 102.
- Processing subsystem 214 provides processing, memory, and on-platform control of munitions platform 102.
- Buoyancy subsystem 216 provides supplementary depth control in conjunction with anchoring subsystem 208.
- Stabilization subsystem 218 dampens rotational and vertical movements of munitions platform 102, particularly during munitions launch.

It will be appreciated that the functional subsystems that compose munitions platform 102 can be physically implemented in a variety of ways. FIGS. 3-8 and the accompanying description disclose one such implementation.

Figure 3:
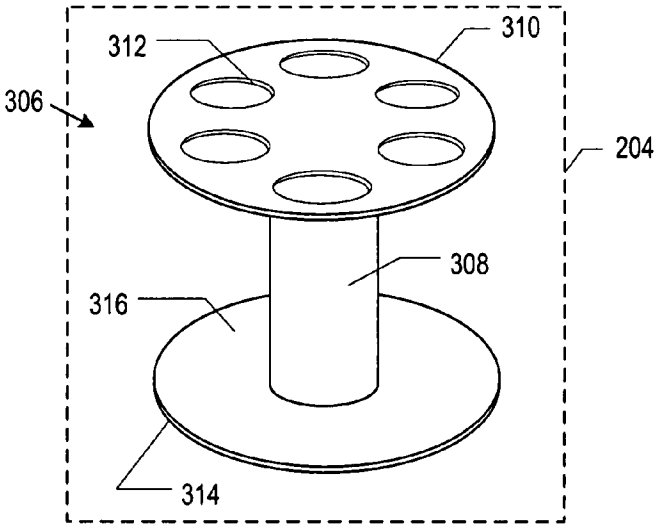
FIG. 3 depicts an embodiment of the structural subsystem of the submersible munitions platform.

Referring now to FIG. 3, the illustrative embodiment of structural subsystem 204 is frame 306. The frame comprises cylinder 308, upper rolling plate 310, and lower rolling plate 314. The rolling plates are attached to the ends of cylinder 308, such as by welding, bolting, etc.

Frame 306 provides mechanical support for other subsystems of munitions platform 102. Furthermore, frame 306, via upper rolling plate 310 and lower rolling plate 314, provides surfaces that enable munitions platform 102 to be readily rolled about as required for logistics movement, deployment, etc. Frame 306 is advantageously formed from materials that are corrosion resistant and relatively light in weight (e.g., aluminum, alloys, etc.).

Upper rolling plate 310 of frame 306 includes a plurality of openings 312. As described further below, these openings aid in coupling munitions launching subsystem 206 to frame 306.

Within cylinder 308 are several additional cylindrical or semi-cylindrical housings that, for the most part, enclose the various subsystems of munitions platform 102. This arrangement is described in further detail below on a subsystem-by-subsystem basis.

Figure 4:
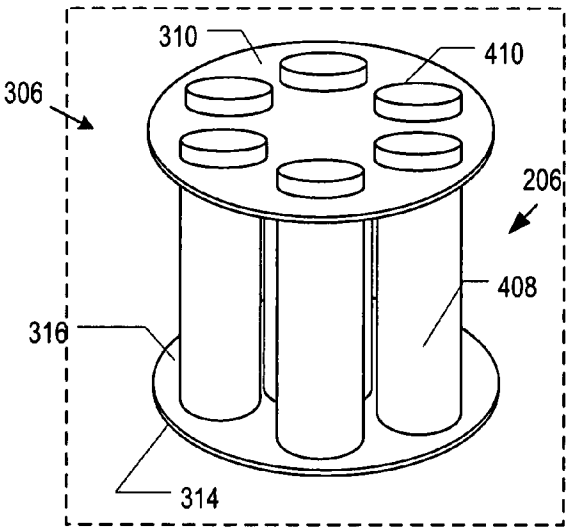
FIG. 4 depicts an embodiment of the munitions launch subsystem of the submersible munitions platform.

FIG. 4 depicts munitions launching subsystem 206, which is coupled to frame 306. In the illustrative embodiment, munitions launching subsystem 206 comprises six munitions canisters 408, which are positioned around cylinder 308. In other embodiments, a greater or lesser number of canisters 408 are coupled to frame 306.

Openings 312 in upper rolling plate 310 receive upper end 410 of each munitions canister. The base of each munitions canister 408 is attached (e.g., bolted, etc.) to upper surface 316 of lower rolling plate 314.

Each munitions canister 408 is waterproof and houses and controls a resident munition. During launch of an airborne munition, the munition pushes through a waterproof "fly-through" canister cover located at the upper end 410 of each munitions canister 408. Fly-through is accomplished with the aid of pressure that is generated by the gases that result from ignition of the munition's chemical propellants. During launch of a waterborne munition, a gas generator is typically activated that opens the canister cover, enabling canister 408 to flood with water and the munition to propel itself out of the canister.

Communications between each munitions canister 408 and processing subsystem 214 (e.g., for launch instructions, etc.) is via a wire harness (not depicted) or, alternatively, can be performed wirelessly.

Figure 5:
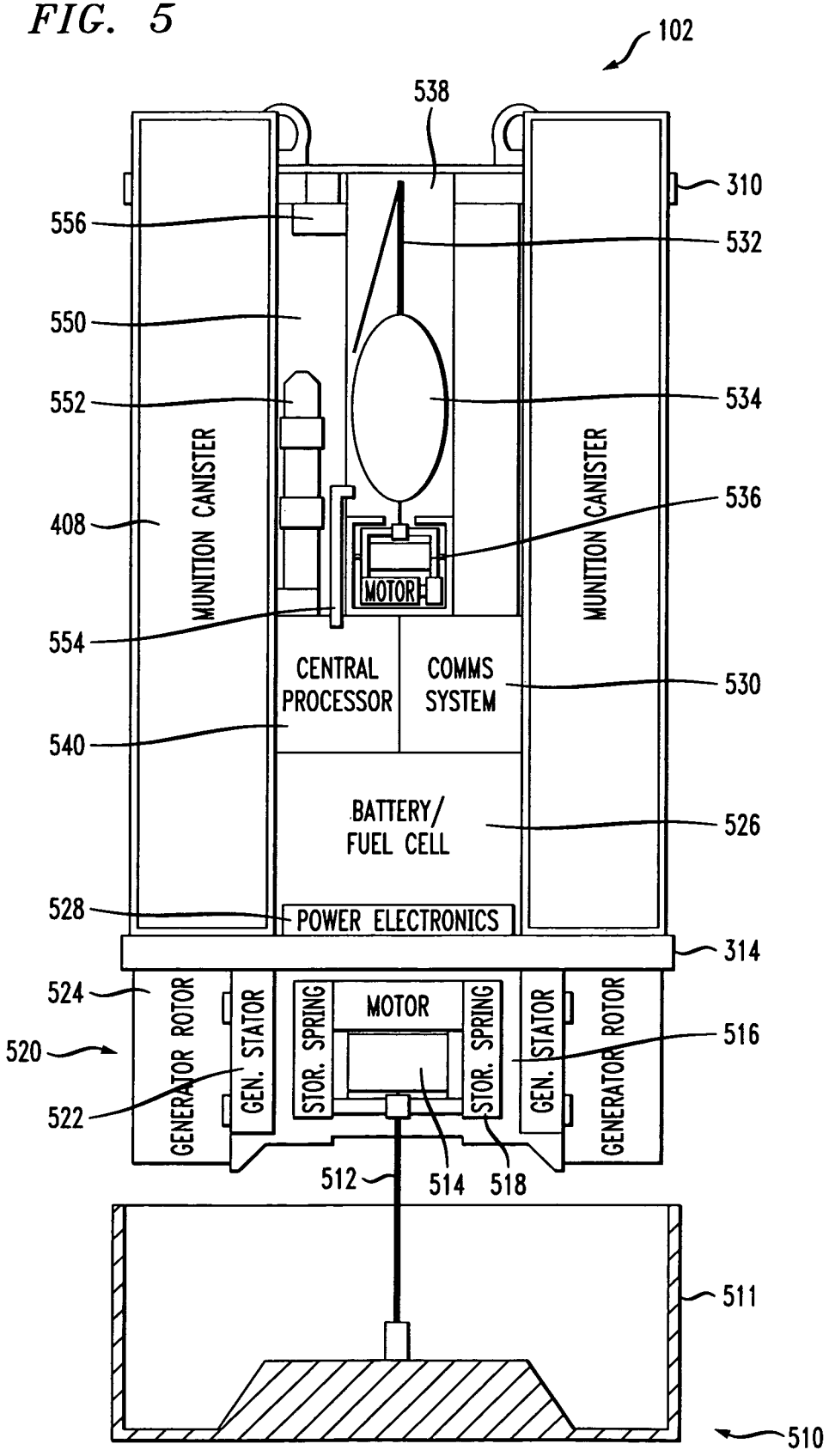
FIG. 5 depicts embodiments of a variety of the subsystems of the submersible munitions platform.
Figure 7:
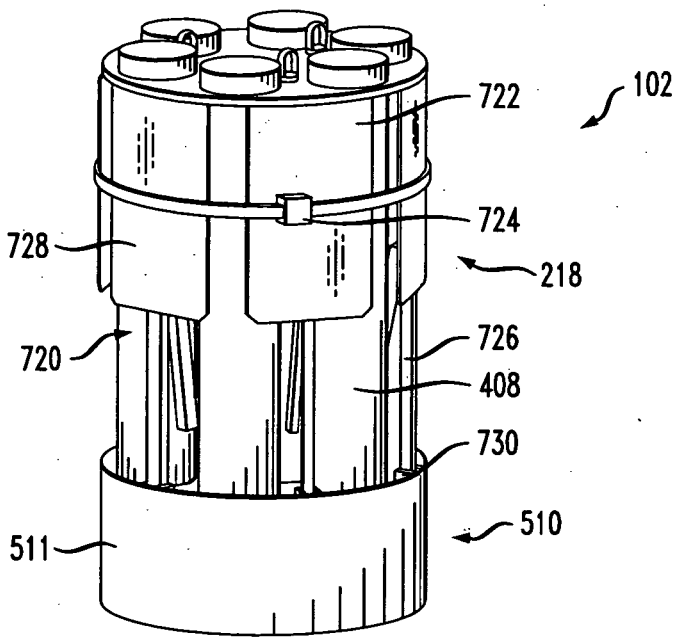
FIG. 7 depicts an embodiment of the stabilization system of the submersible munitions platform, wherein the stabilizers folded.
Figure 8:
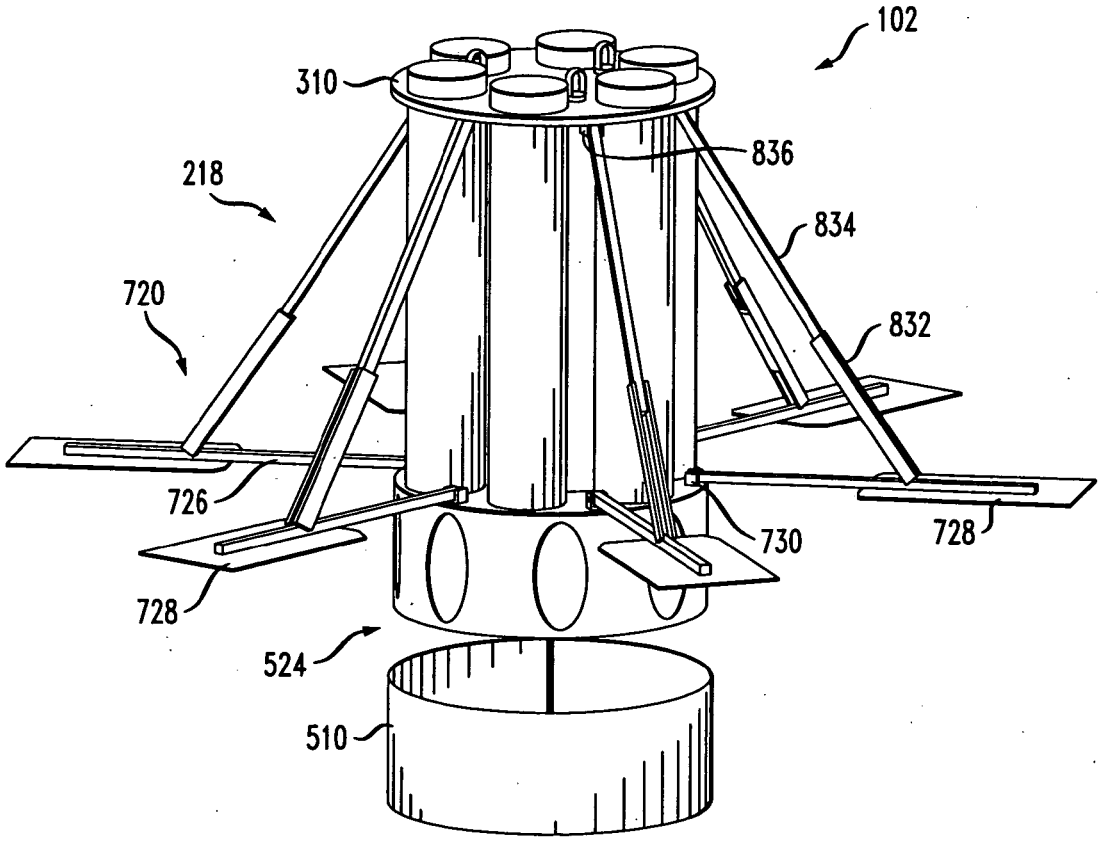
FIG. 8 depicts the submersible munitions platform with stabilizers extended.

FIG. 5 depicts most of the subsystems of munitions platform 102, as well as the relative locations of each subsystem. Stabilization subsystem 218, which is not depicted in FIG. 5, is depicted in FIGS. 7 and 8. For clarity, cylinder 308 is not depicted in FIG. 5.

With continuing reference to FIGS. 2 and 5, the illustrative embodiment of anchoring subsystem 208 includes anchor 510, anchor cable 512, anchor winch 514, anchor winch housing 516, and energy-storage spring 518.

The anchoring system is disposed below lower rolling plate 314; anchor winch housing 516, which is a cylindrical structure, is attached (e.g., bolted, etc.) to the lower surface of the lower rolling plate. Anchor winch 514, which includes a motor and spool, controls the payout of anchor cable 512. One end of the anchor cable is attached to and wound around the spool and the other end of the anchor cable is attached to anchor 510.

Anchoring system 208 enables munitions platform 102 to couple itself to the bottom of the body of water in which it has been deployed. Shortly after deployment in a body of water, anchor winch 514 begins to payout anchor cable 512 so that attached anchor 510 drops away from munitions platform 102, ultimately settling at the bottom of the body of water. Typically, munitions platform 102 will be used in water having a depth of about 200 feet or less.

As anchor cable 512 pays out, the potential energy released by lowering anchor 510 is stored in energy-storage spring 518, which is located within anchor winch housing 516. A typical coiled spring is suitably used as energy-storage spring 518.

When anchor 510 reaches the bottom of the body of water, pay out of anchor cable 512 ceases and excess anchor cable is drawn back around the spool of anchor winch 514. The actual local depth of the water at the deployment location can therefore be determined (e.g., based on encoder readings of the spool, etc.). As described later in this specification, after anchor 510 has settled on the bottom, anchor winch 514 draws munitions platform 102 down to a predetermined loitering depth below the surface of the water. The draw down procedure uses, at least in part, the mechanical energy that was stored in energy-storage spring 518 during the decent of anchor 510.

Still referring to FIGS. 2 and 5, power subsystem 210 provides electrical power to subsystems that consume power on munitions platform 102. For example, in the illustrative embodiment, power subsystem 210 provides power to anchoring system 208 (as required), to communications subsystem 212, processing subsystem 214, and buoyancy subsystem 216.

In the illustrative embodiment, power subsystem 210 comprises tidal flow generator 520, battery or battery and fuel cell 526, and power electronics module 528. Tidal flow generator 520 generates electricity via interaction with local tidal current. In the illustrative embodiment, tidal flow generator 520 comprises a generator stator 522 and generator rotor 524. The generator stator and rotor are attached to the lower surface of rolling plate 314.

During storage, logistics movement, and initial deployment, tidal flow generator 520 is enclosed by extended upper portion 511 of anchor 510 (see, e.g., FIG. 7). As anchor 510 drops away from munitions platform 102 during deployment, as depicted in FIG. 5, tidal flow generator 520 is exposed. FIG. 8 depicts "squirrel cage" arrangement of vents of generator rotor 524. The local tidal currents interact with the vents, thereby causing generator rotor 524 to slowly rotate about generator stator 522.

Rotation of rotor 524 generates a small current—a trickle charge—that is used to charge battery 526, which is disposed within a cylindrical housing nearest and attached to upper surface of lower rolling plate 314. (See, e.g., FIG. 6, housing 626.) Power electronics module 528, which is also attached to upper surface of lower rolling plate 314, controls both the trickle charge of battery 526 and the discharge of battery 526 to power the various subsystems of munitions platform 102. Power electronics module 528 is controlled by processing subsystem 214.

A variety of different types of tidal flow generators are known and can suitably be used in conjunction with power subsystem 210. For example, in some other embodiments, tidal flow generator 520 is implemented as a hydropiezoelectric generator. This technology is under development by Ocean Power Technologies Inc. of Pennington, N.J. In the hydropiezoelectric generator, a hinged, jointed, or otherwise flexible member is appropriately configured, based on hydrodynamics, etc., to move back and forth as it is exposed to tidal currents (or by moving the flexible member through water). Coupled to the flexible member are one or more piezoelectric polymer films or sheets. In some embodiments, the piezoelectric polymer comprises polyvinylidene fluoride. Since they are coupled, the piezoelectric polymer film moves as the flexible member moves. Electrodes are attached to film. The movement (i.e., stretching and releasing) of the film generates high voltage, low-frequency electricity. The electricity passes to the electrodes and is then conditioned, as appropriate, and used to charge battery 520. The hydropiezoelectric generator is most suitable for bodies of water that have a swiftly moving current.

In an alternative embodiment of power subsystem 210 (not depicted), a metal-alloy, galvanic hydrogen generator is used to generate a self-regulating supply of hydrogen. The hydrogen is collected and combined with pressurized oxygen that is stored on munitions platform 102 to activate a fuel cell, which provides a trickle charge to the battery.

Referring still to FIGS. 2 and 5, communications subsystem 212 supports communications to and from munitions platform 102. For example, communications subsystem 212 receives mission-planning details from remote-control module 104 and transmits position and munitions-status data from munitions platform 102 to the remote-control module.

In the illustrative embodiment, communications subsystem 212 comprises radio 530 and associated electronics, floatable folding antenna 532, and an antenna deployment subsystem. The antenna deployment subsystem includes buoy 534 and winch (and associated components) 536. Antenna 532 (before deployment) and winch 536 reside in region 538, which is the central open portion of toroid-like shell 650 of buoyancy subsystem 216. (See also, FIG. 6, shell 650 and region 538.)

When winch 536 is released, antenna 532 and buoy 534 float to the surface of the water. In some embodiments, the energy that is released as buoy 534 rises to the surface is stored in an energy storage spring (not depicted), which is one of the components associated with winch 536. When instructed by processor 540, winch 536 draws down antenna 532, using, in part, the mechanical energy stored in the energy storage spring. Otherwise, winch 536 receives power from battery 526.

Communications subsystem 212 also includes radio 530 and associated electronics, which are disposed in a water-tight, half-cylindrical enclosure below shell 650. (See, e.g., FIG. 6, enclosure 630.) Among other functions, the "associated electronics" provides for communication with processing subsystem 214.

Processing subsystem 214 comprises a processor, memory, and central control electronics, identified generally at 540. The processing subsystem controls all logic and control functionality of munitions platform 102. Processing subsystem 214 is functionally partitioned into two control systems: "systems" control and "launch" control. Anchoring subsystem 208, power subsystem 210, communications subsystem 212, and buoyancy subsystem 216 are managed by the systems control system. The launch control system commands munitions launch subsystem 206. Processing subsystem 214 is contained within a half-cylindrical enclosure that is disposed beneath antenna housing 538 toward the middle of munitions pallet 102. (See, e.g., FIG. 6, enclosure 640.)

Buoyancy subsystem 216 assists anchoring subsystem 208 in controlling the operational depth of munitions platform 102. In the illustrative embodiment that is depicted in FIG. 5, buoyancy subsystem 216 is a water-tight shell having a toroid-like shape (but having a flat upper and lower surface and a rectangular, rather than a circular cross section) that is located within cylinder 308. (See, e.g., FIG. 6, shell 650.) It is attached to the lower surface of upper rolling plate 310.

Components of buoyancy subsystem 216 include buoyancy tank 550, which is defined within the shell 650, compressed air system 552, water level sensor 554, and flooding valve 556. Under the control of processing subsystem 214, these components work together to change the level of water in buoyancy tank 550. Those skilled in the art will know how to make and use buoyancy subsystem 216.

Figure 6:
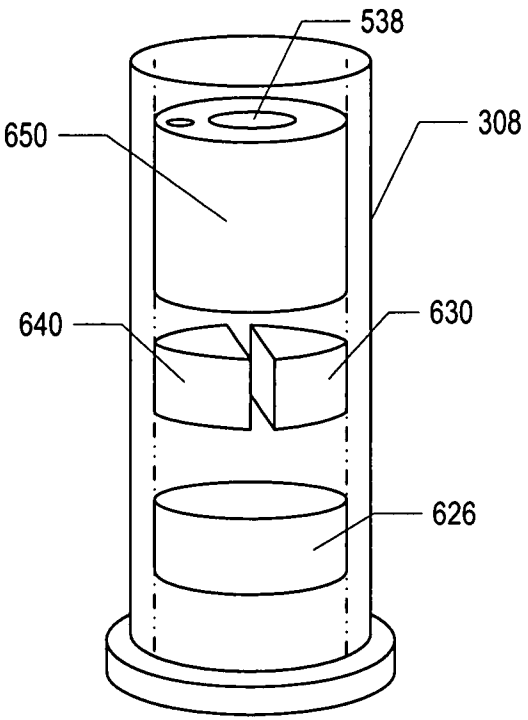
FIG. 6 depicts an exploded view of waterproof enclosures that house various subsystems of the submersible munitions platform.

FIG. 6 depicts an "exploded" view of the various structures within main structural cylinder 308. At the bottom of cylinder 308 is cylindrical battery/fuel cell housing 626. On top of the battery/fuel cell housing are semi-cylindrical communications enclosure 630 and processing system enclosure 640. The flat face of each of these semi-cylindrical enclosures faces one another so that the enclosures collectively define a space-efficient cylindrical structure.

In an alternative embodiment (not depicted), a bifurcated cylinder is used for housing both radio 530 and processor 540. The cylinder should be bifurcated with a metal separator to prevent interference between the radio and the processor.

Shell 650, which defines buoyancy tank 550, is disposed near the top of cylinder 308. Antenna 532 and the antenna deployment subsystem reside within open region 538 of shell 650.

An illustrative embodiment of stabilization system 218 (FIG. 2) is depicted in FIGS. 7 and 8. As shown in those Figures, stabilization subsystem 218 comprises six extendable stabilizers 720 that, when deployed, dampen both rotational and vertical movements of munitions platform 102. FIG. 7 depicts the munitions platform in a storage, logistics deployment, or initial deployment state, wherein stabilizers 720 are held securely against munitions canisters 408, such as by strap 722. To extend the stabilizers, device 724, which secures strap 722, is released. This occurs moments after munitions platform 102 is immersed in the water. Release can be performed manually, such as by pulling a pin (that is attached to a rope) or automatically. FIG. 8 depicts stabilizers 720 in an extended position.

Each stabilizer 720 includes arm 726 and paddle 728. Arm 726 is rotatably attached to lower rolling plate 314 at hinge 730. Each arm 726 is also coupled, near its midpoint, to actuator 832. The actuator, which comprises a housing and a spring (not depicted), couples to rod 834. The rod is rotatably attached to upper rolling plate 310 via hinge 836.

As restraining strap 722 is released, the spring in actuator 832 expands, which causes arm 726 to rotate about its lower hinge point (i.e., hinge 730). Arm 726 rotates downward to an approximately horizontal orientation, which represents the fully extended state of stabilizer 720. As the stabilizer approaches full extension, actuator 832 reaches full extension and automatically locks in place (e.g., using spring-loaded pins in the actuator, etc.).

Figure 9:
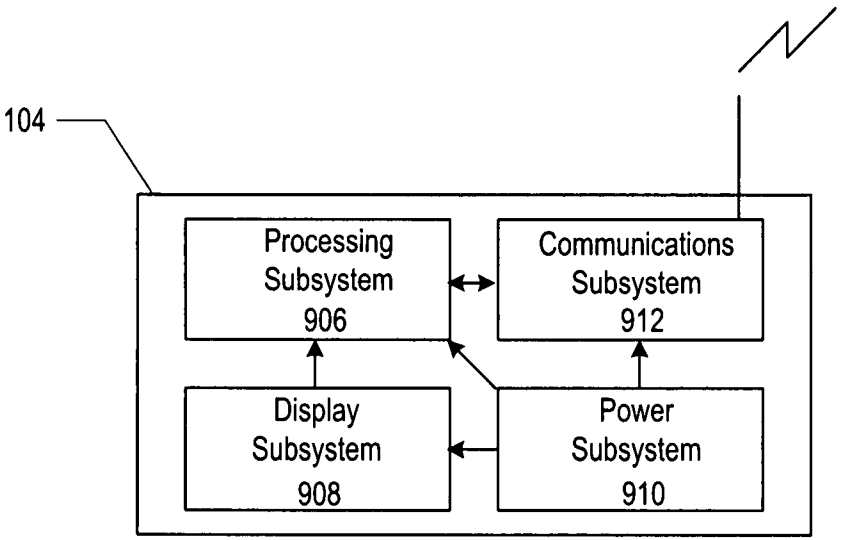
FIG. 9 depicts a functional subsystem diagram of the remote control module of the waterborne munitions system.

FIG. 9 depicts the salient subsystems of remote control module 104. The remote control module is used by a supported force to control one or more munitions platforms 102 from a remote location. As depicted in FIG. 9, remote control module 104 includes processing subsystem 906, display subsystem 908, power subsystem 910, and communications subsystem 912. Since those skilled in the art will know how to make and use these subsystems, they will not be described in detail.

Communications subsystem 912 communicates with munitions platform 102 either via direct line-of-sight or via a satellite communications relay. Processing subsystem 910 and display subsystem 908 are collectively able to display target location maps, munition navigation routes, sensor, and location/communications information for munitions platform 102. As required, remote control module 104 interrogates munitions platform 102 as to the platform's precise location and the status of its munitions. With communications and the status of munitions established, remote control module 104 transmits firing orders that launch one or more munitions, as appropriate, and is further capable of providing times for future communications and/or firing orders.

Figure 10:
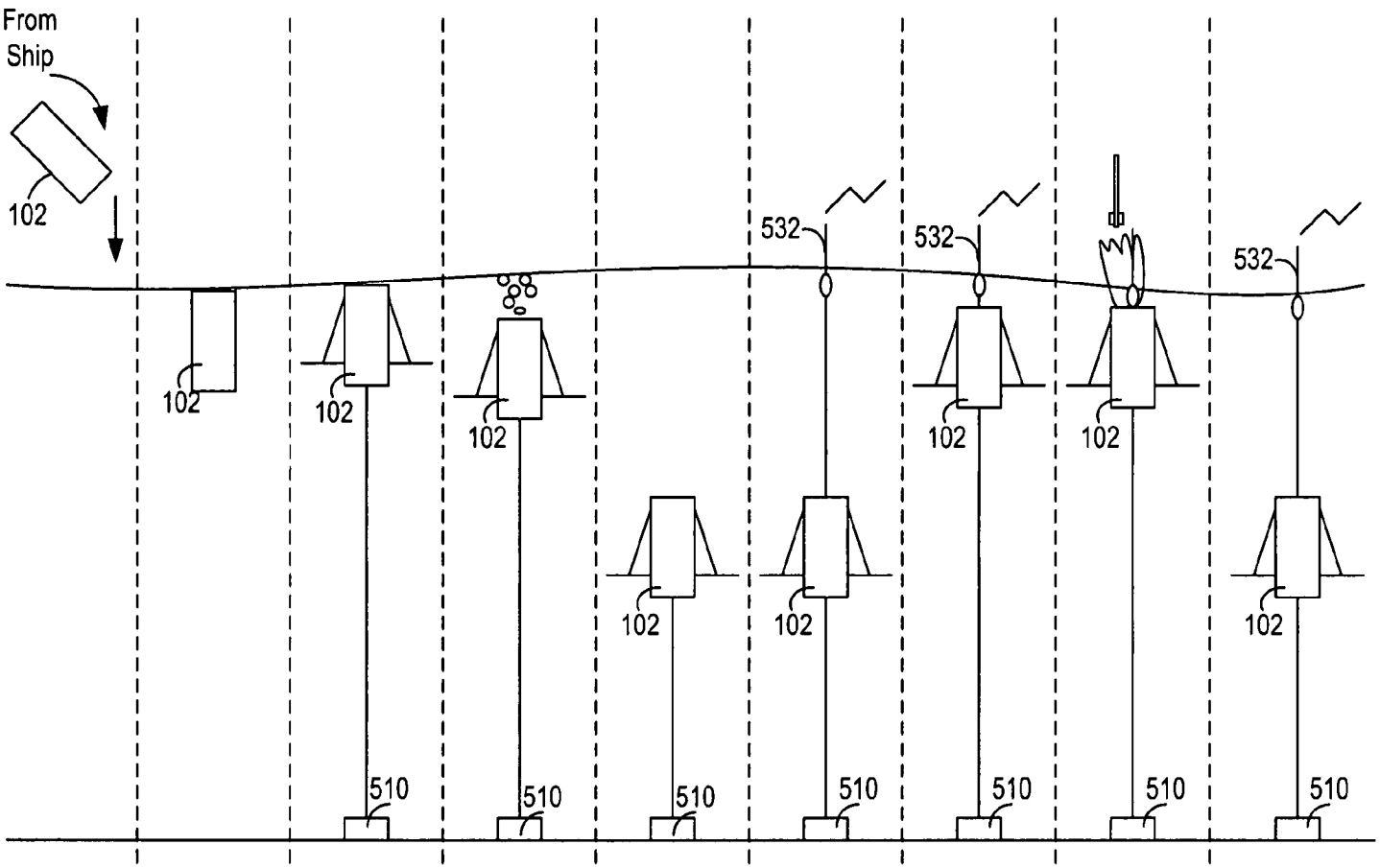
FIG. 10 depicts the concept of operations of the waterborne munitions system.

FIG. 10 depicts the concept of operations of waterborne munitions system 100. As appropriate, specific elements of munitions platform 102 are referenced for the description that accompanies FIG. 10. For clarity, FIG. 10 does not depict such details; rather, the reader is referred to earlier Figures (e.g., FIGS. 4, 5, etc.).

In operation A, munitions platform 102 is deployed by ship, boat, aircraft, submarine, or a swimmer delivery vehicle ("SDV"). Normally, the munitions platform is deployed before or during insertion of the supported military force. To deploy platform 102 from a surface craft, it is rolled from the deck of the craft into water that is between about 30 to 200 feet deep. Since munitions platform 102 is positively buoyant, it initially floats to the surface, as depicted in operation B.

In operation C, which is conducted shortly after munitions platform 102 enters the water, anchor 510 is released. When the anchor reaches the bottom of the body of water, pay out of anchor cable 512 stops and excess cable is drawn back via winch 514. At about the same time as anchor 510 is released, stabilizing arms 720 are extended.

Dropping anchor 510 to the bottom of the body of water decreases the weight of munitions platform 102, further increasing its buoyancy. To reduce the energy required to draw munitions platform 102 down beneath the surface of the water, a volume of air is released from buoyancy tank 550, as per operation D. Although its buoyancy is decreased, the munitions platform remains positively buoyant.

In operation E, munitions platform 102 is drawn down to a loitering depth below the surface of the water by winch 514. At this "loitering" depth, which is about 20 to 30 feet below the surface of the water, munitions platform 102 is very hard to detect. Mechanical energy that was stored in energy storage spring 518 during decent of anchor 510 is used, at least in part, to draw munitions platform 102 to the loitering depth.

At a time programmed into processing subsystem 214, munitions platform 102 releases antenna 532, which floats to the surface of the water, as depicted in operation F. The antenna remains coupled to winch 536.

With antenna 532 deployed, supported troops are able to communicate with munitions platform 102 via a radio link using remote control module 104. In some circumstances, the remote control module generates appropriate targeting information for munitions platform 102.

If munitions launch is not imminent, then remote control module 104 might transmit times for further communications or delayed launching orders to munitions platform 102. As appropriate, remote control module 104 will instruct munitions platform 102 to withdraw antenna 532 to avoid the possibility of detection by hostile forces and re-float it at a specific time in accordance with a time table programmed into processing subsystem 214.

A waterborne munition can be launched from loitering depth. During launch of a waterborne munition, a gas generator is activated that opens the munitions cover. This allows the canister to flood so that the munition can propel itself out of canister 408.

If munitions launch of an airborne munition is imminent, the munitions platform will be directed to float to firing depth, as per operation G. Firing depth for an airborne munition is typically about 1 to 3 feet below the surface of the water. As munitions platform 102 rises to the surface, winch 536 takes up excess cable that tethers antenna 532 to the winch. Also, the antenna deployment winch will take up excess cable that tether antenna 532. At operation H, munitions platform 102 fires one or more munitions in accordance with firing orders.

When instructed to launch an airborne munition, the munition's booster receives a launch signal from the launch control system of processing subsystem 214. The booster then fires, accelerating the munition through the "fly-through" cover disposed at upper end 410 of munition canister 408. The munition continues up through the gas bubble that is generated by the booster's expanding propulsion gases and expelled from the canister during launch. Although the top of munitions platform 102 is at or near the surface of the water, the expanding gas bubble serves to reduce any effects that overhead water might otherwise have on munition launch velocity or munition trajectory.

The reactive force on munitions platform 102 from the air launch is significant. But it has been found that the combination of the tension on anchor cable 512 and the stabilization provided by stabilizers 720 reduces both rotational and vertical movements of munitions platform 102 to within acceptable limits for sequential munitions launches.

After firing one or more munitions in accordance with firing orders, munitions platform 102 is typically directed to submerge to loitering depth to avoid detection, as per operation I. As appropriate, the munitions platform will be directed to withdraw its antenna, as previously described.

It is to be understood that the above-described embodiments are merely illustrative of the present invention and that many variations of the above-described embodiments can be devised by those skilled in the art without departing from the scope of the invention. For example, in this Specification, numerous specific details are provided in order to provide a thorough description and understanding of the illustrative embodiment of the present invention. Those skilled in the art will recognize, however, that the invention can be practiced without one or more of those details, or with other methods, materials, components, etc.

Furthermore, in some instances, well-known structures, materials, or operations are not shown or described in detail to avoid obscuring aspects of the illustrative embodiments. It is understood that the various embodiments shown in the Figures are illustrative, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily all embodiments. Consequently, the appearances of the phrase "in one embodiment," "in an embodiment," or "in some embodiments" in various places throughout the Specification are not necessarily all referring to the same embodiment. Furthermore, the particular features, structures, materials, or characteristics can be combined in any suitable manner in one or more embodiments. It is therefore intended that such variations be included within the scope of the following claims and their equivalents.

What is claimed is:

1. A system comprising:

a munitions platform for use in water, wherein the munitions platform comprises:

a frame for providing mechanical support, wherein the frame includes:

(a) a housing having at least one waterproof compartment for receiving an electronics-containing subsystem;

(b) a first rolling plate; and (c) a second rolling plate, wherein the first and second rolling plates are similarly-sized and are disposed at opposite ends of the housing, wherein the plates are circular and, at a circumference thereof, provide a rolling surface;

a munitions subsystem for providing munitions and underwater launch capability, wherein the munitions subsystem comprises a plurality of sealed munitions canisters that are disposed around and outside of the housing; and a depth control subsystem for actively changing a depth of the munitions platform under water.

2. The munitions platform of claim 1 and further comprising a power subsystem for providing electrical power to the munitions platform, wherein the power system comprises at least one energy storage device for storing the electrical power, and wherein the at least one energy storage device is disposed in the housing.

3. The munitions platform of claim 2 wherein the power subsystem further comprises a generator.

4. The munitions platform of claim 3 wherein the generator is powered by motion of the water.

5. The munitions platform of claim 1 further comprising a stabilization system, wherein said stabilization system is coupled to the frame and further wherein the stabilization system is operable to dampen movement of the frame upon deployment.

6. The munitions platform of claim 5 wherein the stabilization system comprises a plurality of extendable arms that are coupled to the frame.

7. The munitions platform of claim 6 wherein the extendable arms are spring biased to deploy in the absence of a restraint, and wherein the stabilization system further comprises a restraining strap that restrains the extendable arms in a stowed position against and substantially parallel to the munitions canisters.

8. The munitions platform of claim 1 further comprising a communications subsystem for communicating with a remotely-located control station, wherein the communications subsystem comprises a radio, and wherein the radio is disposed in the housing.

9. The munitions platform of claim 8 wherein the communications subsystem further comprises a floatable antenna, wherein the floatable antenna is coupled to the frame and further wherein the floatable antenna is retractable within the housing.

10. The munitions platform of claim 1 wherein the depth control subsystem comprises:

an anchoring subsystem including a winch and an anchor, wherein the winch is coupled to the frame and the anchor is tethered to the winch; and a buoyancy-control subsystem for altering the buoyancy of the munitions platform, wherein the buoyancy-control subsystem is disposed in the housing.

11. The system of claim 8 further comprising a remote control module that is physically separate from the frame, wherein the remote control module transmits data to and receives data from the communications subsystem.

12. The munitions platform of claim 1 wherein the munitions canisters are parallel to the housing.

13. A system comprising:

a munitions platform for use in water, wherein the munitions platform comprises:

a housing that contains a plurality of subsystems, some of which reside in at least one waterproof compartment in the housing;

a first rolling plate; and a second rolling plate, wherein the first and second rolling plates are disposed proximal to opposite ends of the housing, wherein the rolling plates collectively enable the munitions platform to be rolled across a surface contacting only edges of the first and second plates, and further wherein the first rolling plate includes a plurality of openings for receiving a plurality of munitions canisters, one canister per opening;

a munitions subsystem for providing munitions and underwater launch capability, wherein the munitions subsystem comprises the plurality of munitions canisters, and wherein the munitions canisters are disposed around and outside of the housing and are substantially parallel thereto;

a depth-control subsystem for actively changing the depth of the munitions platform under water; and a processor for directing the depth-control subsystem to change depth of the munitions platform as a function of desired operation of the munitions platform, wherein the processor is disposed in one of the waterproof compartments in the housing.

14. The munitions platform of claim 13 further comprising a communications subsystem, at least a portion of which is disposed in the housing, wherein the communications subsystem receives commands relating to the desired operation of the munitions platform, and further wherein the commands received by the communications subsystem are transmitted to the processor.

15. The system of claim 14 further comprising a remote control module that is physically separate from the frame, wherein the remote control module transmits data to the communications subsystem.

16. The munitions platform of claim 13 further comprising:

a plurality of extendable arms that are coupled to the first and second rolling plates and that are spring-biased to deploy from a stowed state in the absence of a restraint; and a restraining strap that encircles the munitions platform and functions as the restraint, wherein the restraining strap is configured to automatically release when the munitions platform is deployed into the water.

17. The munitions platform of claim 16 wherein a second end of each munitions canister abuts the second rolling plate and a first end of each munitions canister extends through a respective one of the holes in the first rolling plate.

18. The munitions platform of claim 13 wherein the depth-control subsystem comprises:

an anchoring subsystem having a winch and an anchor; and a buoyancy-control subsystem for altering the buoyancy of the munitions platform, wherein the buoyancy-control subsystem is disposed in the housing.

19. A system comprising:

a munitions platform for use in water, wherein the munitions platform comprises:

a housing that contains a plurality of subsystems, including a communications subsystem, and further wherein the housing contains a waterproof compartment in which the communications subsystem resides;

a first rolling plate;

a second rolling plate, wherein the first and second rolling plates are circular in shape, are disposed at opposite ends of the housing, and have respective first and second rolling surfaces at respective circumferences thereof, and wherein the first and second rolling plates are suitably dimensioned so that the first and second rolling surfaces collectively enable the munitions platform to be rolled across a surface;

a munitions subsystem for providing munitions and underwater launch capability, wherein the munitions subsystem comprises a plurality of munitions canisters, and wherein the munitions canisters are disposed around and outside of the housing and radially inward of the first and second rolling surfaces; and a depth-control subsystem for actively changing the depth of the munitions platform under water responsive to at least one of either a command from a remote operator or a pre-programmed routine.

20. The munitions platform of claim 19 wherein the depth-control subsystem is further operable to limit movement of the frame in a horizontal direction.

21. The munitions platform of claim 19 further comprising a plurality of extendable arms that are coupled to the first and second rolling plates and that are spring-biased to deploy from a stowed state in the absence of a restraint.

22. A method for operating a munitions platform in water, wherein the munitions platform has:

a frame for providing mechanical support, wherein the frame comprises a housing having at least one waterproof compartment for receiving an electronics-containing subsystem;

a munitions subsystem that provides underwater launch capability for a plurality of munitions, wherein the munitions subsystem comprises a plurality of sealed munitions canisters that contain the munitions and which are disposed around and outside of the housing; and a depth control subsystem for actively changing a depth of the munitions platform under water, wherein the method comprises:

(a) deploying the munition platform in water;

(b) submerging the munitions platform to a loitering depth;

(c) floating the munitions platform to a firing depth that is shallower than the loitering depth;

(d) launching an airborne munition from the munitions platform in accordance with firing orders; and (e) re-submerging the munitions platform to the loitering depth after satisfying the firing orders.

23. The method of claim 22 wherein the operation of submerging the munitions platform to a loitering depth further comprises:

(i) releasing an anchor that is coupled to the munitions platform;

(ii) decreasing the buoyancy of the munitions platform but maintaining positive buoyancy;

(iii) drawing the munitions platform toward the anchor until the loitering depth is reached.

* * * * *